United States Patent [19]

Leykamm et al.

[11] 4,351,177

[45] Sep. 28, 1982

[54] APPARATUS FOR MAKING A BEVEL GEAR

[75] Inventors: Herbert Leykamm, Lauf; Siegfried Knabel, Nuremberg, both of Fed. Rep. of Germany

[73] Assignee: Kabel-und Metallwerke Gutehoffnungshütte Aktiengesellschaft, Hanover, Fed. Rep. of Germany

[21] Appl. No.: 165,796

[22] Filed: Jul. 3, 1980

[30] Foreign Application Priority Data

Jul. 5, 1979 [DE] Fed. Rep. of Germany ..... 2927192

[51] Int. Cl.[3] ..... B21K 1/30

[52] U.S. Cl. ..... 72/354; 72/359; 72/360

[58] Field of Search ..... 29/159.2; 72/354, 357, 72/358, 359, 360

[56] References Cited

U.S. PATENT DOCUMENTS 2,285,575 6/1942 Elbertz ..... 29/159.2

4,008,599 2/1977 Dohmann ..... 72/354

*Primary Examiner*—Lowell A. Larson

*Attorney, Agent, or Firm*—Ralf H. Siegemund

[57] ABSTRACT

The apparatus includes a die, a punch, and a concentric counterpunch having an annular front extension; the die cavity has a spline-shaft-like extension and the counterpunch extension has a frustroconical tip and/or lateral teeth which mesh with the spline shaft. The counterpunch is spring-mounted upon the punch carrier.

5 Claims, 4 Drawing Figures

1
3
4
13
2
15
L
l
5
12
11
10
7
6
7
8
14
8
14a
14,14a
2a
2a

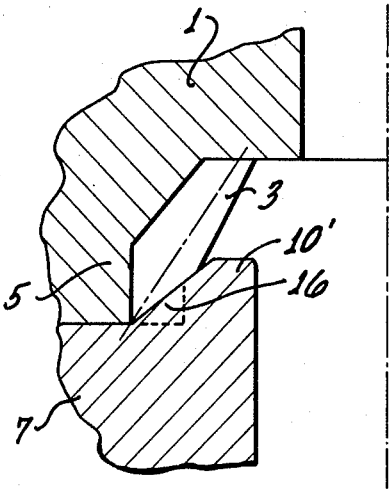
Fig. 3
Fig. 4
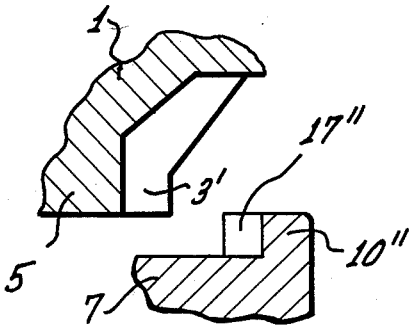
Fig. 2
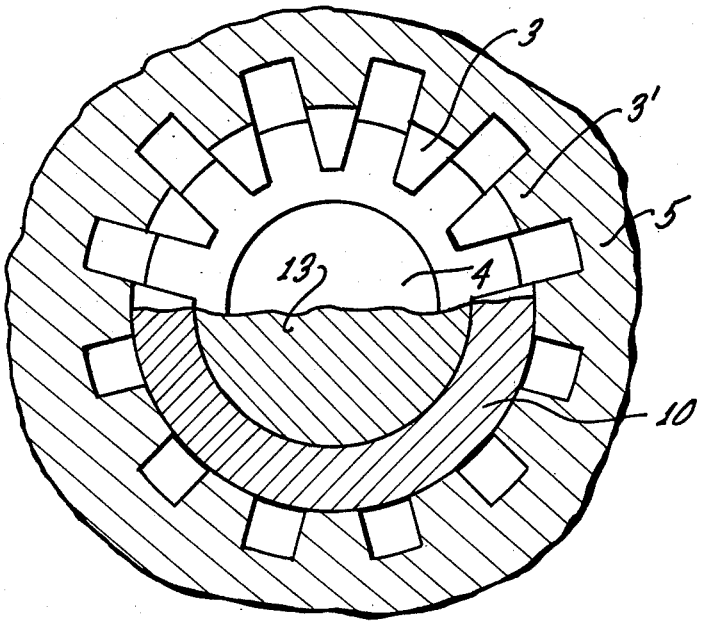

APPARATUS FOR MAKING A BEVEL GEAR

BACKGROUND OF THE INVENTION

The present invention relates to the making of bevel gears.

Bevel gears are made, for example, by placing a cylindrical, metallic (e.g., steel) blank into a die having a cavity portion contoured in accordance with the "negative" of the gear to be made; further, a punch is used, coaxially received by a control sleeve or counterpunch, to force the blank into the die cavity for press-forming the gear. This kind of method is disclosed, for example, in German Pat. No. 24,46,413; see also U.S. Pat. Nos. 3,731,516 and 4,068,599. These prior art methods relate particularly to features to assure completely filling the small diameter portion of the die cavity without having to exert excessive pressure. U.S. Pat. No. 4,008,599, in particular, suggests the use of a punch whose outer diameter is approximately equal to the diameter of a circle defined by the intersection of the bottom of the die cavity with the pitch cone of the bevel gear grooves and ridges, at a tolerance not exceeding a 20-percent diameter difference. This patent discloses also a truncated cone projecting from the punch and matching a cone defined by the ridges of the bevel gear cavity. Since the diameter of the punch is a parameter for determining the diameter of the blank, it appears inevitable that the blank sits on the ridges. Consequently, the die will wear out at these parts. The methods as per these references are very satisfactory from a point of view of avoiding the making of incomplete gears; but the dies wear out rather rapidly.

DESCRIPTION OF THE INVENTION

It is an object of the present invention to provide a new and improved apparatus for making a bevel gear, using press working rather than machining, and under conditions which avoid undue wear and tear of the die.

It is a particular object of the invention to provide a new and improved apparatus for making a bevel gear in a single step, using simple cylindrical blanks; particularly, blanks which will not sit on die ridges during the first phases of press working.

It is a specific object of the present invention to provide a new and improved apparatus for making a bevel gear, using a die whose cavity is the "negative" of the gear to be made, and using further a punch concentrically received by a counterpunch.

In accordance with the preferred embodiment of the present invention, it is suggested to improve the apparatus as per the specific object, by providing the die cavity with an extension resembling a hollow spline shaft, the ridges of which continue the ridges of the bevel gear cavity; the counterpunch has an annular cylindrical extension which fits into the spline shaft portion of the cavity, its diameter being a little smaller than the diameter of a circle defined by the innermost portions of the inwardly extending ridges of the spline shaft. This extension of the counterpunch can, thus, extend into the die cavity to press-work material for causing it to fill the large diameter portion of the die cavity. In addition, the counterpunch extension is provided with means for controlling material flow during the final press-working phase. In one form, the extension is provided with a frustoconical tip whose cone angle equals the cone angle of the root cone of the bevel gear to be made. This tip is particularly instrumental in ensuring that the various portions of the die cavity will be completely filled. Additionally or alternatively, one may provide the counterpunch extension with teeth which reach into the spaces between the spline shaft ridges. This way, one prevents premature flow into large diameter portions of die prior to completely filling the grooves of the bevel gear die. A frustoconical tip tends to fill the radial outermost portion of the cavity, particularly during the final phases and more particularly of the larger diameter cavity because the bevel of that extension permits the extension to be higher and to penetrate deeper into the die cavity. Teeth-like, lateral extensions "meshing" the spline ridges tend to form the material that has escaped by back-flow, by forcing it radially out and up, thereby ensuring complete filling of the die cavity. In either case, the inventive apparatus reduces the excess material that is to be removed subsequently from the large diameter portion of the bevel gear. This, in turn, permits the use of a lighter weight blank.

In view of this particular equipment, one may use a blank whose outer diameter is smaller than the smallest bevel gear root circle. Thus, the blank will not sit on any ridges in the die cavity. The punch should have the same outer diameter, and the counterpunch has preferably the same inner diameter. The latter tool diameters should always be equal to the diameter of th blank; but that diameter may be smaller than the smallest bevel gear root circle. A limit here is given by the maximum bending load that the blank can take without kinking; it should begin to flow first!

In a particular, advantageous construction, the punch is linked directly to a punch carrier to be moved therewith; the counterpunch may sit on that carrier or body via springs. Thus, the counterpunch has a maximum forward stroke in which it abuts the die. During initial phases of operation, the counterpunch will be retained in that position, receiving in part the blank while the punch advances. The counterpunch is moved off the die by the material that has laterally flowed into the die cavity and filled it; overfill and back-flow now tend to lift the counterpunch off. During the final phases, counterpunch and punch advance in unison to complete the bevel gear in that the extension of the counterpunch produces an indent and its outer portions fill the large-diameter portion of the die, the contour of that extension being instrumental as described.

The preferred embodiment of the invention, the objects and features of the invention, and further objects, features and advantages thereof, will be better understood from the following description taken in connection with the accompanying drawings.

DESCRIPTION OF THE DRAWINGS

FIG. 2 is a section view through a portion of the equipment of FIG. 1, as indicated therein by the arrow 2.

FIG. 3 is a section view of a modification of a counterpunch extension shown in FIG. 1; and FIG. 4 is an exploded section view of a further modification involving the same extension.

Proceeding now to the detailed description of the drawings, FIG. 1 shows a press tool or machine which includes generally an upper portion 1 and a lower portion 2. These designations are arbitrary and tied to the illustration. The press could well be worked upside down. Part 1 constitutes the die having a cavity 1*a* which is configured in accordance with the negative of a bevel gear to be made. The cavity is, thus, of an overall conical, or better, frustraconical configuration, but has ribs 3 which will form the grooves of the gear.

Figure 1:
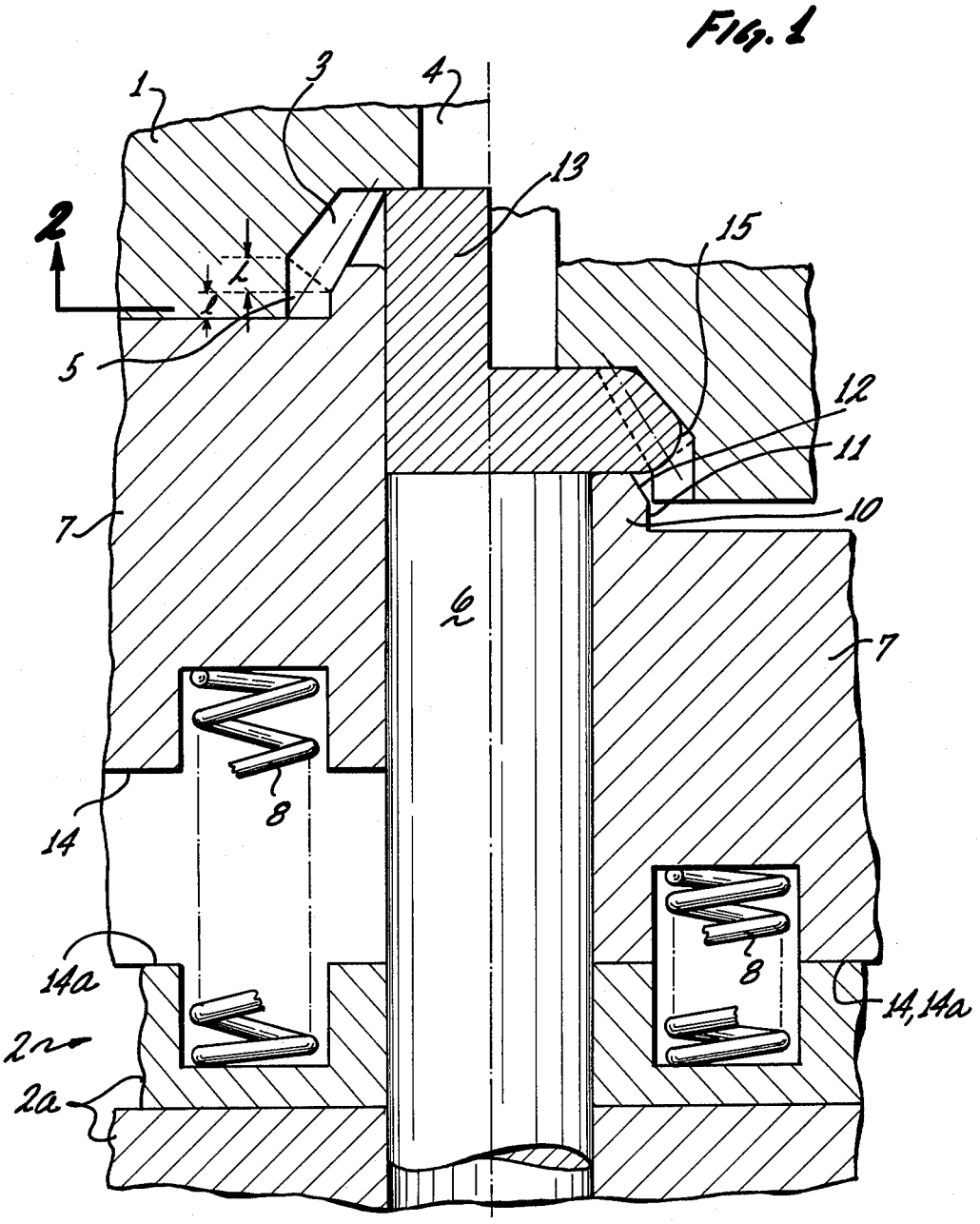
FIG. 1 is a section view of the interior of the equipment in accordance with the preferred embodiment of the present invention for practicing the best mode thereof; the figure illustrates that equipment, being symmetrical, in a bisected manner, the left-hand side representing an operating state just prior to press-forming, the right-hand side showing an intermediate state of the forming process.

The cavity has an extension 4 for receiving the ejector (not shown). On the other end, die cavity 1*a* has a cylindrical spline-like extension 5, into which also extend the ridges 3; the gearing is, thus, continued into that cylindrical portion. The axial length l of that portion 5 should be at least about equal to a length L, as defined by the geometry of the bevel gear and, particularly, by the groove's depth and the cone angle of the bevel.

Tool portion 2 is comprised of a press punch 6, being secured to tool body or punch carrier 2*a*. A counterpunch 7 is operatively connected to tool body or punch carrier 2*a* by means of springs 8 to be movable relative thereto and coaxially in relation to punch 6 which is secured to body 2*a*.

Counterpunch 7 has an annular projection 10 which includes a cylindrical part 11 and a conically contoured tip part 12. The cylindrical part 11 has a diameter which is slightly less than the diameter of the circle defined by cylindrical ridge portions 3' of ridges 3 in spline shaft extension 5. The conical part 12 continues the cylindrical part, its cone angle being the same as the cone angle of the root cone of the bevel gear to be made, which is a cone along the radially innermost portions of the ridges 3.

Turning now specifically to the left-hand portion of FIG. 1, the process begins with the insertion of a solid cylindrical blank 13. The punch-counterpunch combination 2 has been advanced relative to the die (or vice versa) until the front end of the counterpunch 7 abuts die 1, so that a portion of the blank 13, including the end facing the punch, is inserted in the counterpunch, to be held therein against radial flow. The process, as shown, indicates that actually the die is moved up rather than that the punch is moving down. This aspect is dynamically unimportant. It is convenient to describe the apparatus with a moving punch and an assumed stationary die.

Upon further advancing the punch, the small-diameter portion of the die cavity is filled with blank material. Punch advance continues, causing the material to flow back and to act against extension 10. The punch advance has compressed the spring 8 to some extent; and now counter punch 7 is lifted off die 1 as soon as the press flow of the material can overcome the spring bias.

Upon further continuation of press punch advance, a terminal but intermediate portion is reached when the surfaces 14 and 14*a* of counterpunch and punch holder 2*a* abut. The right-hand portion of FIG. 1 illustrates this state of the operation. Still further advance of the punch 6, now together with counterpunch 7, causes the material to be displaced from a portion which will become a central bore; and the material will flow into the large-diameter portion of the die as well as into the spline-shaft-like extension 5. The front face of punch 6 and the front face of extension 10 of the counterpunch are coplanar during this final completing step. It can readily be seen that this last-mentioned flow of the material will occur only when all portions of the die proper are filled. Moreover, the conical tip 12 of extension 10 tends to fill all radially outer portions of the die cavity.

The region 15 of the bevel gear being made has to be finished by machining, so that the removal of any excess material that flowed into the spline-shaft-like extension 5 is not an additional working step.

FIG. 3 shows a modification of the counterpunch extension, denoted here as 10'. This extension has gear-like radial protrusions 16 which enter the space between the spline-shaft-like ridge extensions 3' of the die. The outer diameter of these protrusions should still be a bit smaller than the "gearing" of the die, including particularly the grooves between ridges 3 and their extensions 3'. This feature makes certain that the outermost portions of the bevel gear die grooves fill completely with material before the material will flow generally axially in a reverse manner into spline shaft portion 5. Extension 10' has also a conical tip; but it may be cylindrical only, in which case it will not penetrate as deeply into the die cavity.

FIG. 4 shows a modification of FIG. 2; the extension 10" is of overall cylindrical configuration from which extend the gear-like teeth 17". The extension 10" will not penetrate as deeply into the die cavity. However, it can readily be seen that, by contouring the periphery of the extension from counterpunch 7, one can obtain different types and degrees of control as regards the axial-radial flow of the material, initially as well as upon gradual retraction of the counterpunch.

Returning now to the description of the operation in general, the parts 1 and 2 are retracted from each other in each instance; and the bevel gear is ejected by an appropriate ejector acting from and through bore 4. The gear still includes some excess material adjacent to the large-diameter portion, which is removed by machining in order to complete the gear.

The invention is not limited to the embodiments described above; but all changes and modifications thereof, not constituting departures from the spirit and scope of the invention, are intended to be included.

We claim:

1. Apparatus for making bevel gears by pressworking, including a die having a cavity contoured for making a bevel gear and including ridges for forming the grooves of the bevel gear; further including a punch and a counterpunch concentrical to and receiving the punch, the improvement comprising:

means defining an annular extension of the die cavity, resembling a hollow spline shaft including radially inwardly extending ridges which continue the the ridges of the bevel gear cavity;

an annular extension on a front end of the counterpunch, the extension including a cylindrical portion whose diameter is slightly smaller than a diameter defined by a circle along the spline shaft ridges; and additional contour means on the extension for limiting and controlling material flow in the die cavity when the extension projects into the die cavity.

2. Apparatus as in claim 1, the additional means being a frustoconical tip of the extension; the tip having a cone angle equal to the cone angle of the root cone of the bevel gear to be made.

3. Apparatus as in claim 1 or 2, the additional means being or including gear-like extensions which project in between the ridges of the spline extension upon insertion of the extension into the die cavity.

4. Apparatus as in claim 1 or 2, the inner diameter of the counterpunch being about equal to the smallest root circle of the bevel gear to be made.

5. Apparatus as in claim 1, wherein the counterpunch and the punch are operatively linked by spring means being compressed upon advance of the punch, the punch and the counterpunch abutting for advance in unison after the material in the die cavity has acted against the counterpunch.

* * * * *